US008795583B2

(12) United States Patent
Heller et al.

(10) Patent No.: US 8,795,583 B2
(45) Date of Patent: Aug. 5, 2014

(54) NOZZLE TUBE CHANGER HAVING A DUMMY PLATE FOR A CASTING DEVICE FOR PRODUCING METALLURGIC PRODUCTS

(75) Inventors: Josef Heller, Menznau (CH); Jean-Daniel Cousin, Lucerne (CH)

(73) Assignee: Stopinc Aktiengesellschaft, Hunenberg (CH)

( * ) Notice: Subject to any disclaimer, the term of this patent is extended or adjusted under 35 U.S.C. 154(b) by 0 days.

(21) Appl. No.: 13/976,532

(22) PCT Filed: Jan. 6, 2012

(86) PCT No.: PCT/EP2012/000046

§ 371 (c)(1), (2), (4) Date: Jun. 27, 2013

(87) PCT Pub. No.: WO2012/095282

PCT Pub. Date: Jul. 19, 2012

(65) Prior Publication Data

US 2013/0299119 A1 Nov. 14, 2013

(30) Foreign Application Priority Data

Jan. 11, 2011 (CH) ..... 00044/11

(51) Int. Cl.
*B22D 41/56* (2006.01)

(52) U.S. Cl.
CPC ..... *B22D 41/56* (2013.01)
USPC ..... 266/287; 222/590; 222/607

(58) Field of Classification Search
CPC ..... B22D 41/56
USPC ..... 266/287; 222/590, 591, 597, 607
See application file for complete search history.

(56) References Cited

U.S. PATENT DOCUMENTS

| | | | | |
|---|---|---|---|---|
| 5,494,201 | A | 2/1996 | Szadkowski | |
| 5,693,249 | A | 12/1997 | Szadkowski | |
| 6,902,121 | B2 * | 6/2005 | Kawano et al. | 239/390 |
| 2010/0314421 | A1 * | 12/2010 | Ebner et al. | 222/607 |
| 2013/0299119 | A1 * | 11/2013 | Heller et al. | 164/438 |

FOREIGN PATENT DOCUMENTS

| | | | |
|---|---|---|---|
| DE | 69405112 | T2 | 2/1995 |
| DE | 69513627 | T2 | 7/1996 |

* cited by examiner

*Primary Examiner* — Scott Kastler
(74) *Attorney, Agent, or Firm* — Brian Roffe

(57) ABSTRACT

The pouring spout changer according to the invention is characterized in that it is provided with a dummy plate (14) for closing the casting channel of the casting device in an emergency. The dummy plate (14) can be brought into the closed position by the same actuation member (11) by means of which a worn pouring spout (21) is replaced by a new pouring spout (22) during normal operation. The changing device can also be used as a casting nozzle changer, preferably with a nozzle gripper for removing the worn casting nozzles.

20 Claims, 8 Drawing Sheets

Figure 1A:
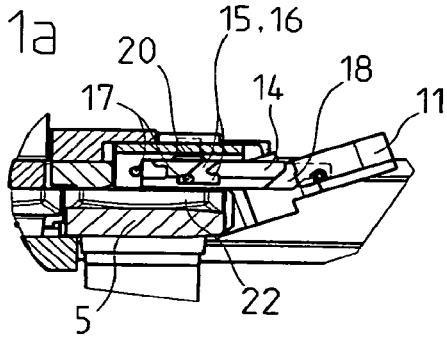

NOZZLE TUBE CHANGER HAVING A DUMMY PLATE FOR A CASTING DEVICE FOR PRODUCING METALLURGIC PRODUCTS

The invention relates to a nozzle tube changer for a casting device for producing metallurgic products, comprising an actuation member for moving an unused nozzle tube from a waiting position into the casting position in which the nozzle tube is pressed against an outlet sleeve of the casting device that forms a casting channel with the latter.

The term "nozzle tube" is understood to also include casting nozzles which fulfil essentially the same function as the nozzle tubes and differ from the latter mainly by the different overall lengths.

Nozzle tube changers of the type specified at the start are known to serve, in particular in casting devices for producing continuously cast products, to exchange a worn nozzle tube for a new one without interrupting the operation of the casting plant. This is accomplished by moving the new nozzle tube into the casting position and carrying away the worn nozzle tube.

A changing device of this type is disclosed by EP 0 714 332. It is essentially characterised in that it has an additional plate lying between the head plates of the used nozzle tube and the unused replacement spout, the used nozzle tube being pushed out beyond the casting position by the additional plate when the replacement spout is moved into the casting position. The nozzle tube changer does not include any means for quickly closing the casting channel in an emergency, for example if the nozzle tube breaks or in similarly serious situations. This is a disadvantage with regard to the operating safety of the plant.

Other changing devices are also known in which a dummy plate has to be pivoted into the moving position, and this also has to be executed manually and in a laborious manner.

The object underlying the invention is to avoid this disadvantage and to provide a nozzle tube changer of the type specified at the start which brings about both the spout change and closure of the casting channel in an emergency by the simplest possible means.

This object is achieved according to the invention by a nozzle tube changer for a casting device for producing metallurgic products that includes an actuation member for moving a nozzle tube from a waiting position into the casting position in which the nozzle tube is pressed against an outlet sleeve or similar of the casting device that forms a casting channel with the outlet sleeve. The nozzle tube changer is provided with a dummy plate serving to close the casting channel, and which during normal operation, is positioned in a waiting position and in an emergency, can be pushed in by an actuation member, pushing the nozzle tube away.

This changer according to the invention enables automatic operation for the introduction of a dummy plate which is integrated into the changer and can be pushed to below the casting channel in a matter of seconds.

Since the changing and closing functions are executed by one and the same actuation member, it is guaranteed that the spout changer can only carry out one or the other function as required.

The invention also makes provision such that during normal operation the dummy plate in the waiting position is held over the plane of movement of the nozzle tube and can be lowered automatically onto the plane of movement of the nozzle tube in an emergency. Therefore, said nozzle tube can also be used for the dummy plate in an emergency. In this way the structure of the changing device is simplified.

The actuation member according to the invention consists of a carriage moved in the direction of movement of the nozzle tube and a carrier connected flexibly to the latter transversely to the direction of movement. In this way the plane of action of the carrier can be adjusted automatically.

Advantageously the dummy plate can be coupled to the carrier by means of preferably hook-shaped suspension elements.

In order to control the passage of the dummy plate from the waiting position to the plane of movement provision is made according to the invention such that the dummy plate is preferably provided on both sides with a horizontal longitudinal groove and a guide groove lying at an angle to the latter, which co-operate with a stationarily arranged pin. It is advantageous here if the dummy plate is preferably loaded with a pretensioning spring, also arranged stationarily, on its side lying opposite the suspension.

It is also advantageous in the sense of a simple and easily controllable drive if the actuation member can be driven by a preferably hydraulic linear drive the piston rod of which is coupled to the carriage of the actuation member.

In changing devices for casting nozzles the invention makes provision such that the linear drive with the carriage is arranged on a long side of the changing device and that there is provided on the opposite long side a nozzle gripper by means of which the worn casting nozzle can be removed from the changing device.

The nozzle gripper has a swivel-out receiving head that has a holding magnet for the worn casting nozzle and that is fastened to the end of an actuation rod that is moved parallel to the direction of movement of the casting nozzle such as to be able to be rotated, retracted and extended. In this way manipulation is facilitated and the structure of the device is made simpler.

Figure 1:
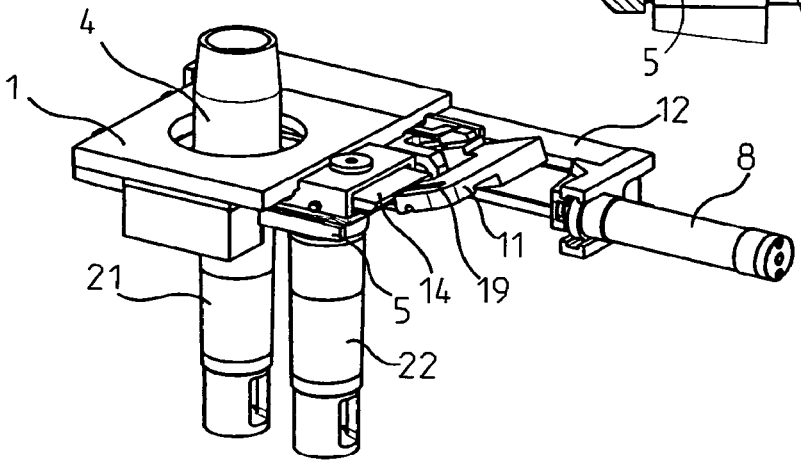
Figure 2A:
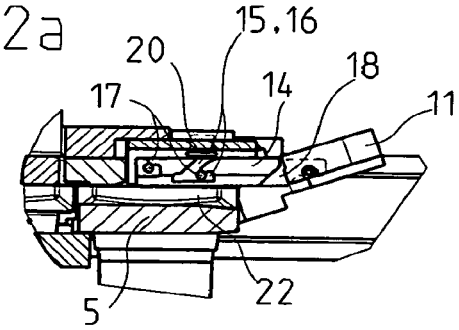
Figure 2:
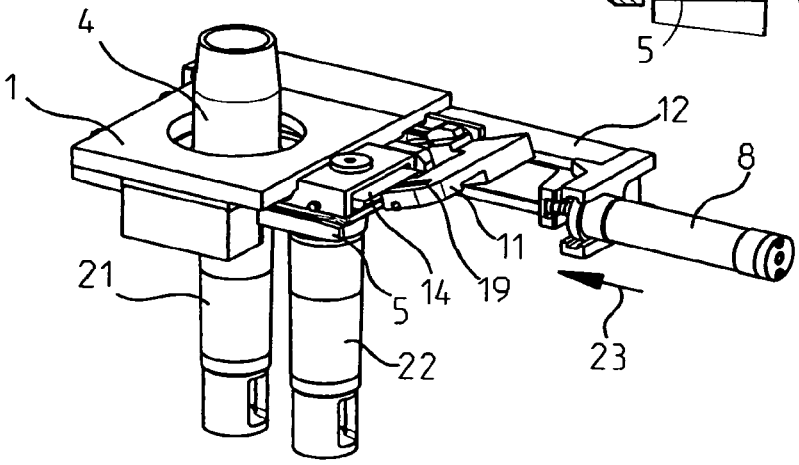
Figure 3A:
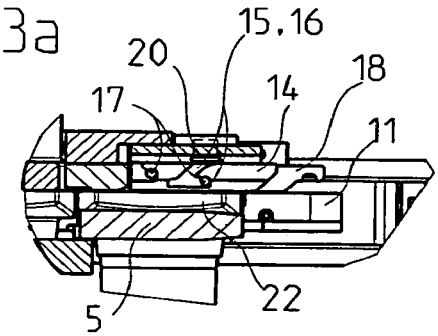
Figure 3:
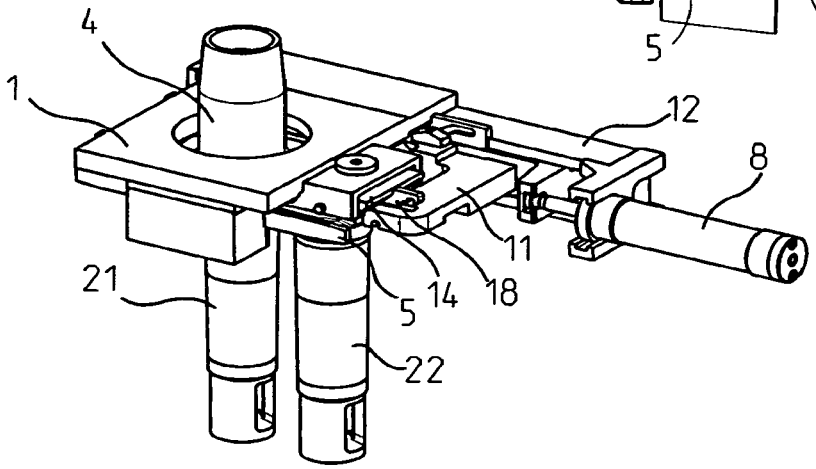
Figure 4A:
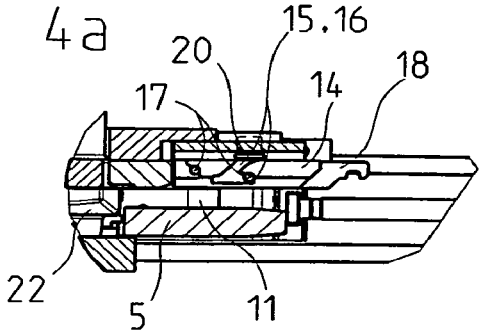
Figure 4:
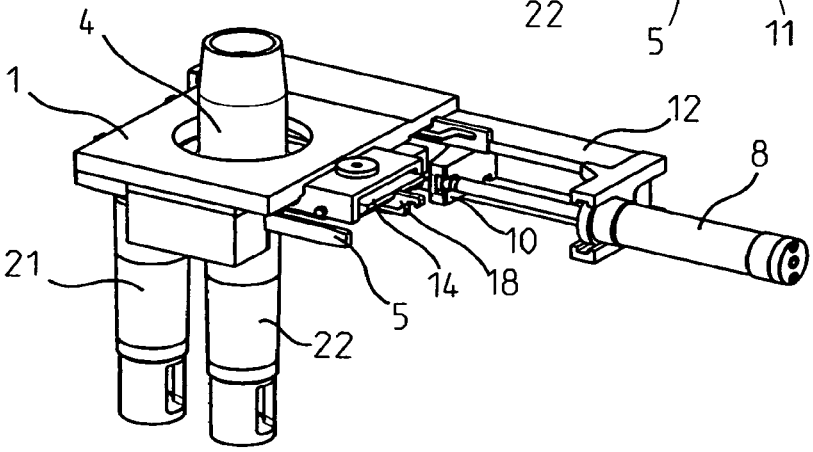
Figure 5A:
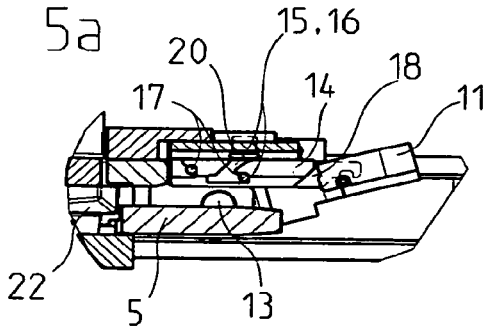
Figure 5:
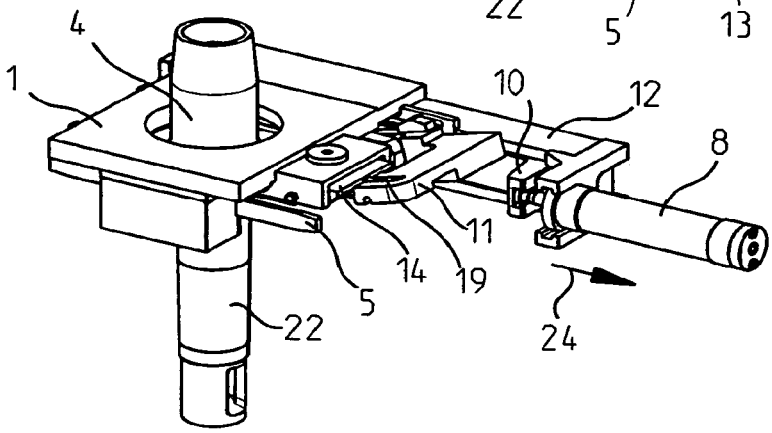
Figure 6A:
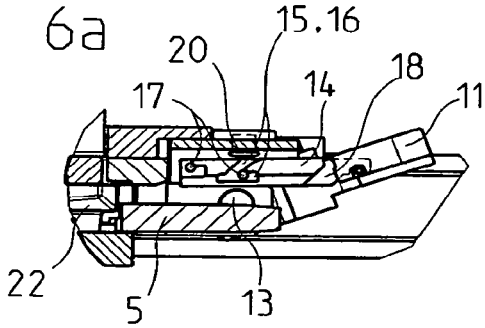
Figure 6:
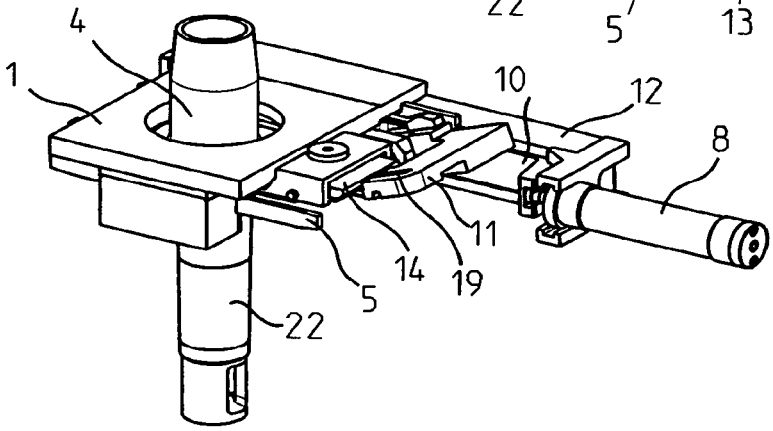

In the following the invention is described in more detail using two exemplary embodiments with reference to the drawings. These show as follows:

FIGS. 1 and 1*a* show a changing device for nozzle tubes, shown partially in section and in the initial position, FIGS. 2 and 2*a* show the changing device from FIG. 1 upon initiation of the changing process, with the dummy plate in the waiting position, FIGS. 3 and 3*a* show the changing device from FIG. 1, with the dummy plate suspended, FIGS. 4 and 4*a* show the changing device from FIG. 1, after pushing a replacement spout into the casting position, FIGS. 5 and 5*a* show the changing device from FIG. 1, upon introducing the return into the initial position.

Figure 7A:
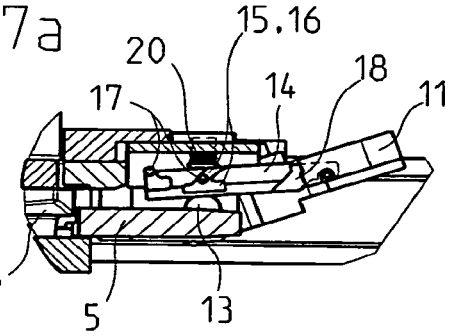
Figure 7:
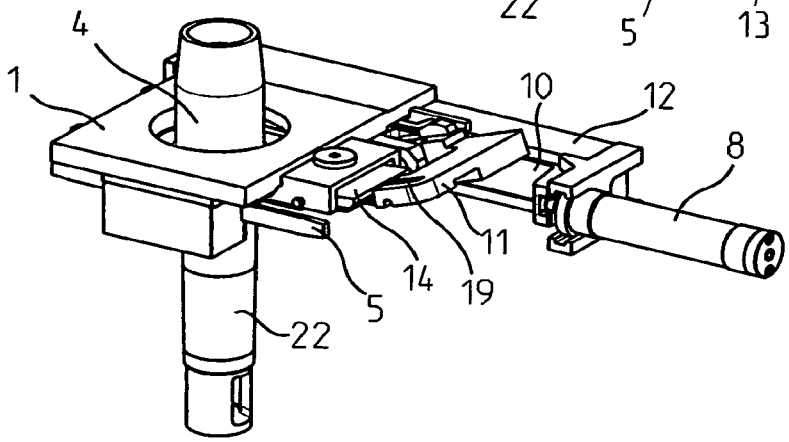
Figure 8A:
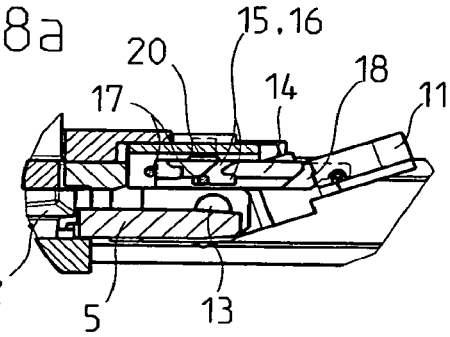
Figure 8:
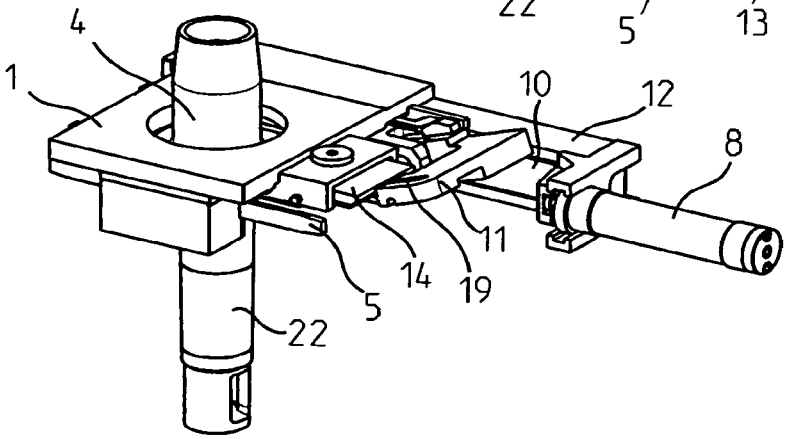
Figure 9A:
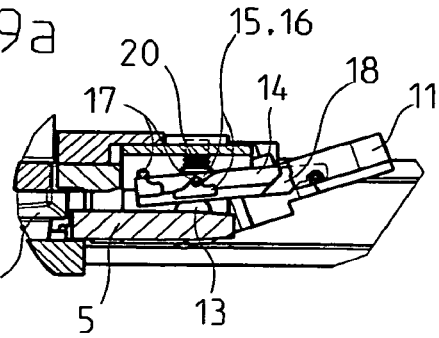
Figure 9:
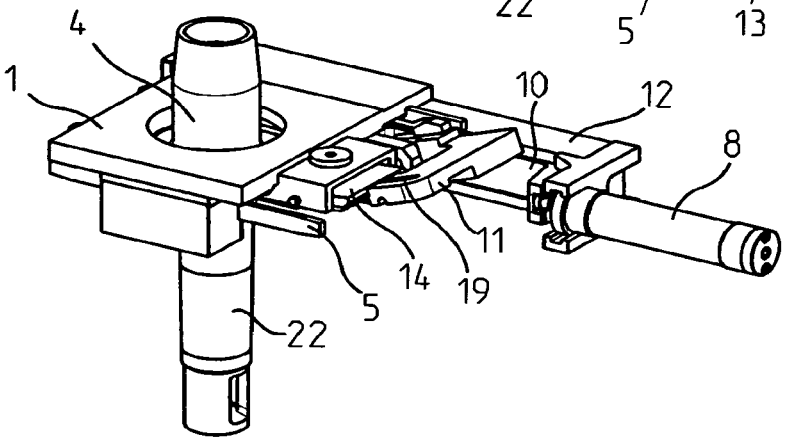
Figure 10A:
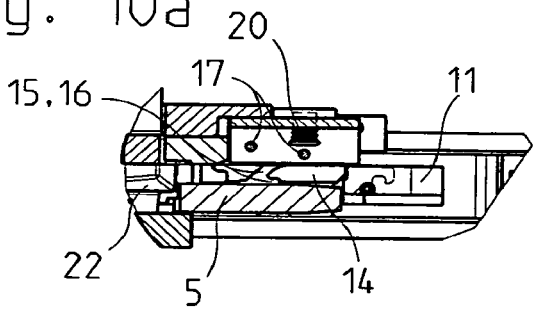
Figure 10:
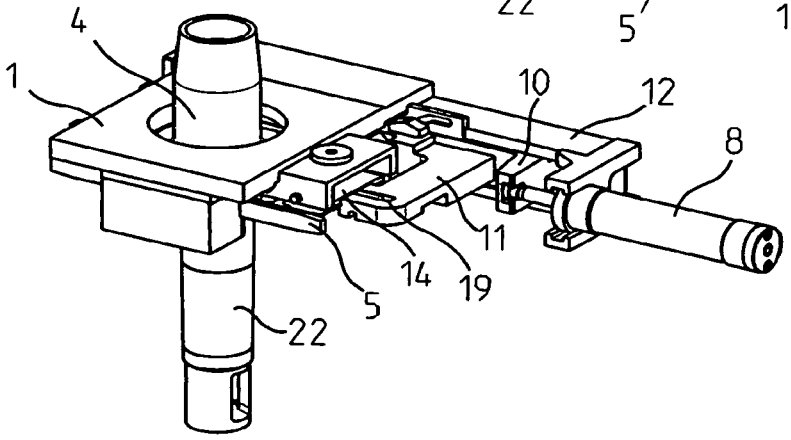
Figure 11A:
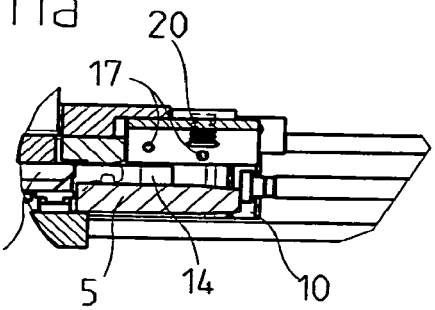
Figure 11:
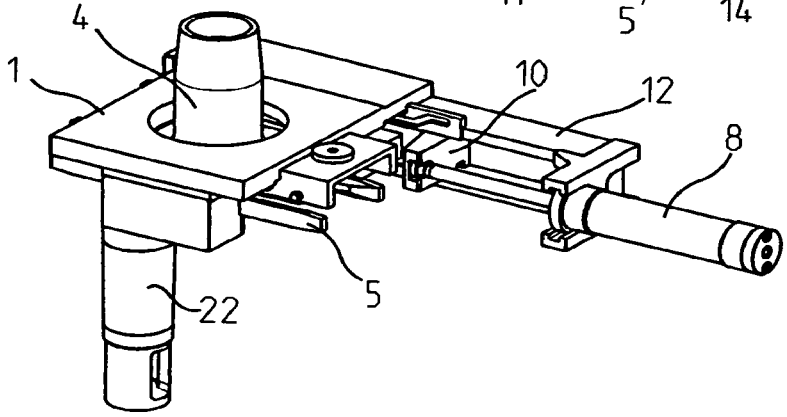
Figure 12:
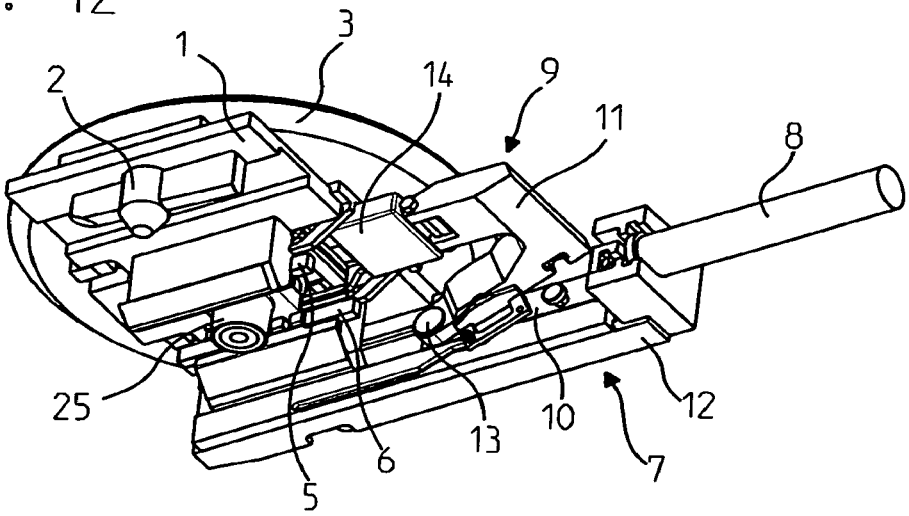
Figure 16:
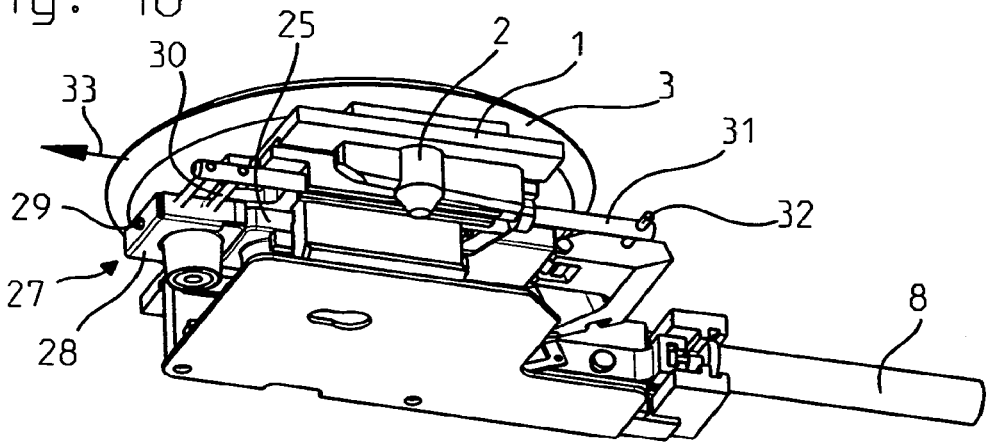
Figure 17:
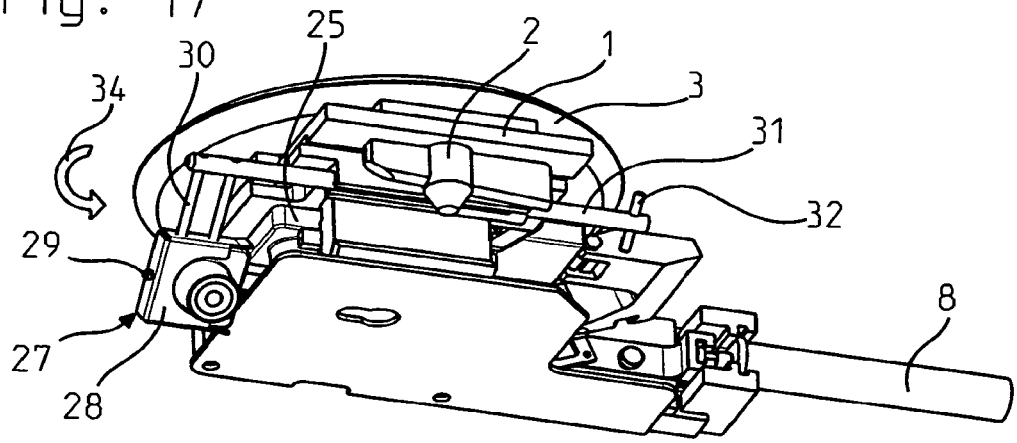
Figure 18:
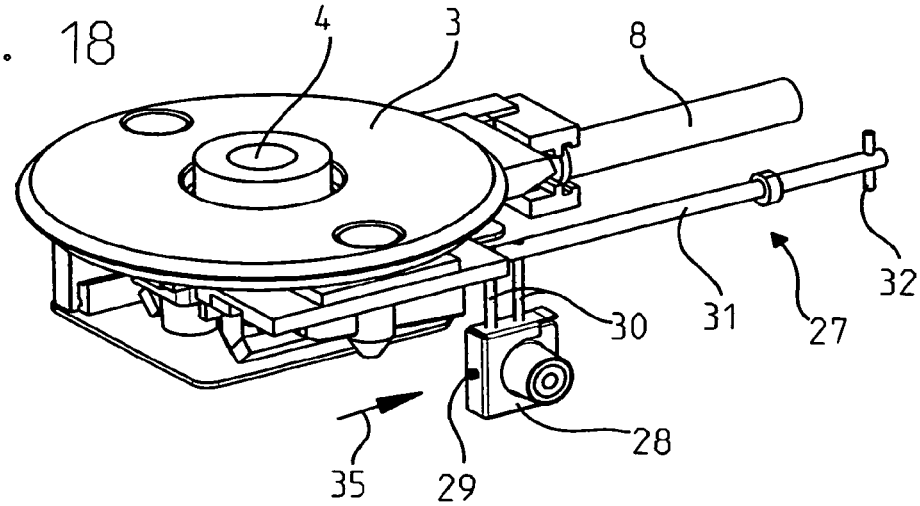

FIGS. 6, 6*a*, 7 and 7*a* show the changing device from FIG. 1, during the return with the dummy plate suspended, FIGS. 8 and 8*a* show the changing device from FIG. 1, shown after reaching the initial position, FIGS. 9 and 9*a* show the changing device from FIG. 1, shown upon initiation of a closing process in an emergency situation, FIGS. 10 and 10*a* show the changing device from FIG. 1 with the dummy plate lowered, FIG. 11 is the changing device from FIG. 1, with the dummy plate pushed into the closing position, FIGS. 12, 13, 14 and 15 show a changing device for casting nozzles, shown in four different phases of an emergency closing process, FIG. 16 is the changing device from FIGS. 12 to 15, with a nozzle gripper for the worn casting nozzles, with the gripper extended, FIG. 17 is the changing device from FIG. 16, shown with the gripper swivelled out, and FIG. 18 is the changing device from FIG. 16, with the gripper retracted.

The changing devices according to FIG. 1 to FIG. 11 and FIG. 12 to FIG. 18 are essentially identical in structure. As can be seen in particular from FIGS. 12 to 18, they have a base plate 1 which is fastened by means of wedge elements 2 to the base wall of a casting device 3 that has an outlet sleeve 4. Guide rails 5, 6 are attached to the base plate 1. They form a plane of movement for the nozzle tubes to be exchanged or the casting nozzles to be exchanged.

Also attached to the base plate 1 is a drive system 7 comprising a hydraulic linear drive 8 and an actuation member 9 for the nozzle tubes or casting nozzles to be exchanged. The actuation member 9 is composed of a carriage 10 and a carrier 11, the carriage 10 coupled to the piston rod of the linear drive 8 being moved in guides 12 in the direction of movement of the nozzle tubes or casting nozzles, whereas the carrier 11 is hinged on the carriage 10 about an axis 13 transverse to the direction of movement.

Moreover, the changing devices are provided with a dummy plate 14 with which the casting channel of the casting device 3 can be closed in an emergency. In the dummy plate 14 a horizontal longitudinal groove 15 and a guide groove 16 arranged at an angle to the latter are provided on both sides, both grooves co-operating with cylinder pins 17 engaging in them on the carriage 10. In the changing device according to FIG. 11 the grooves are positioned on the carriage, while the cylinder pins are positioned on the dummy plate, i.e. in reverse.

By means of this arrangement for assigning the cylinder pins to the dummy plate and the grooves 15, 16 to the carriage, with this changing device according to FIG. 11 to FIG. 18 it is achieved that the dummy plate 14 (not illustrated in detail) can be retracted back into the waiting position and that consequently a new replacement nozzle can be pushed in. Therefore, the casting process is interrupted for a short period of time and consequently the casting process can be continued by burning up the frozen molten steel in the outlet sleeve 4.

If the cylinder pins 17 are pushed into the horizontal longitudinal grooves, the dummy plate 14 is then located over the plane of movement of the nozzle tubes or casting nozzles in the waiting position. Here it is displaced from the plane of movement to such an extent that in the changing process the unused nozzle tube or the unused casting nozzle can be pushed, unhindered, below the dummy plate. The latter can be coupled to the carrier 11 by hook-shaped suspension elements 18 which can hook into corresponding recesses 19 in the carrier 11. On the opposite side of the suspension the dummy plate 14 is acted upon by a pre-tensioning spring 20 supported against the base plate 1 or a means with the same effect.

The nozzle tube changer according to FIGS. 1/1*a* to FIGS. 11/11*a* functions as follows:

During normal operation a nozzle tube 21 is located in the casting position shown in FIG. 1 in which the nozzle tube is pressed against the outlet sleeve 4 of the casting device forming the casting channel with the latter. Next to this an unused replacement spout 22 is located in the waiting position. The dummy plate 14 lies over the replacement spout 22, also in the waiting position. It is coupled to the carrier 11 with the suspension elements 18 (FIGS. 1/1*a*).

In order to initiate the changing process the carrier 11 is driven by the linear drive 8 in the direction of the arrow 23 (FIGS. 2/2*a*), the dummy plate 14 being moved forwards and the pin 17 passing into the longitudinal groove 15 so as to prevent the dummy plate 14 from falling down. The carrier 11 is then suspended from the dummy plate 14 and is now able to push the replacement spout 22 through into the casting position previously occupied by the nozzle tube 21 (FIGS. 3/3*a*).

In FIGS. 4/4*a* the end position of the changing process is shown. The carrier 11 has pushed the replacement spout 22 into the casting position and has pushed the used nozzle tube 21 out of the casting position, during which the dummy plate 14 remains in the waiting position. After this, the carrier 11 is moved back by the linear drive 8 in the direction of the arrow 24 (FIGS. 5/5*a*). It hooks itself onto the dummy plate 14 again (FIGS. 6/6*a*), the effect of which is that the latter does not fall out due to the co-operation of the pins 17 with the sloping guide grooves 16 (FIGS. 7/7*a*).

The nozzle tube changer is then once again in the initial position illustrated in FIGS. 8/8*a* in which, however, for example in an emergency situation, there is now no replacement spout inserted in the changing device. Since there is no replacement spout, the dummy plate 14 is not in position and so can give way downwards because the pins 17 now pass along in the guide grooves 16 in the direction of the open groove ends, and this is supported by the spring force of the pre-tensioning spring 20 (FIGS. 9/9*a*).

The dummy plate 14 falls down onto the plane of movement of the nozzle tube 21, 22 and, in an emergency, the carrier 11 can push it into the closing position on the same plane of movement (FIGS. 10/10*a*), while on its part it pushes the nozzle tube 22 in operation out of the casting position (FIGS. 11/11*a*). In this way the emergency closure of the casting channel is brought about with the aid of the dummy plate 14.

Since only a single drive system with a common actuation member and a common plane of movement are provided for the changing process and the emergency closure, the changing device has a simple structure and is functionally reliable because it can only perform one or the other function respectively due to its construction.

The function of the casting nozzle changer according to FIGS. 12 to 15 is identical to that of the spout changer according to FIGS. 1/1*a* to 11/11*a*. In the initial position shown in FIG. 12 the casting nozzle 25 is in the casting position, while the dummy plate 14 is in the waiting position. It is held up by the pins 17 pushed into the guide grooves 16.

Figure 13:
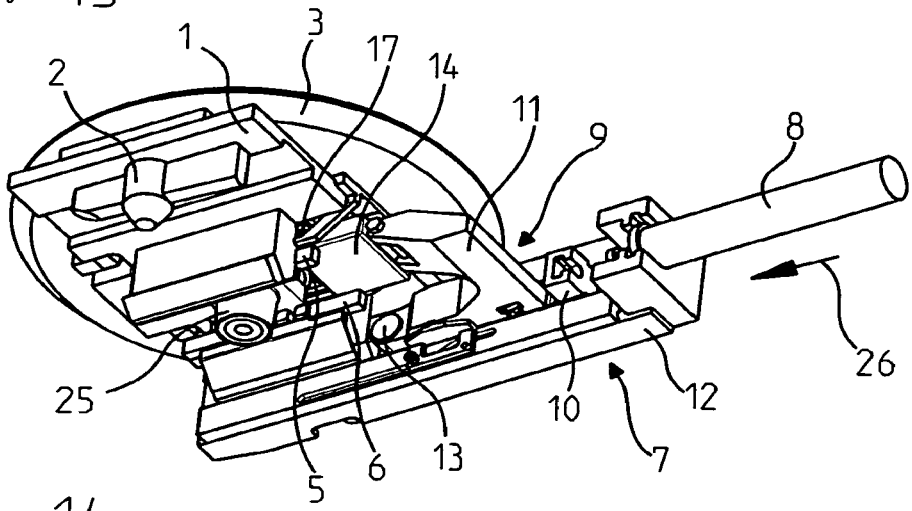
Figure 14:
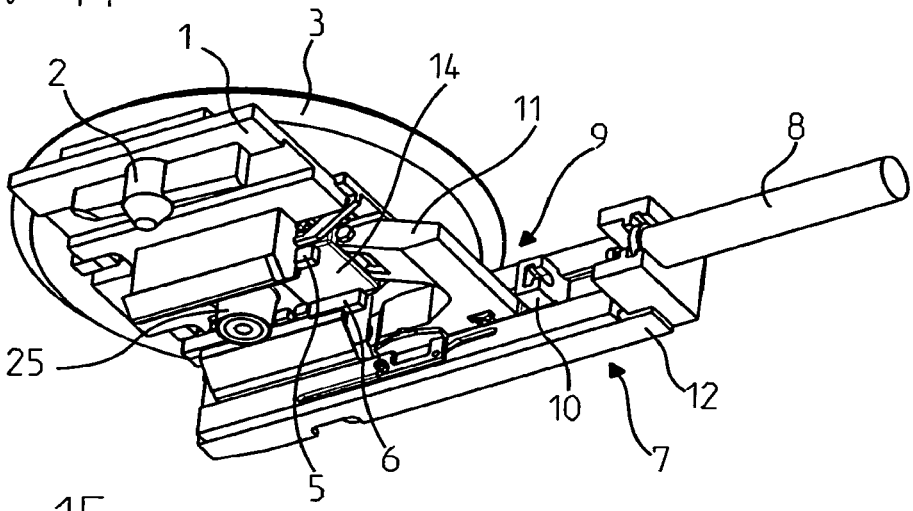
Figure 15:
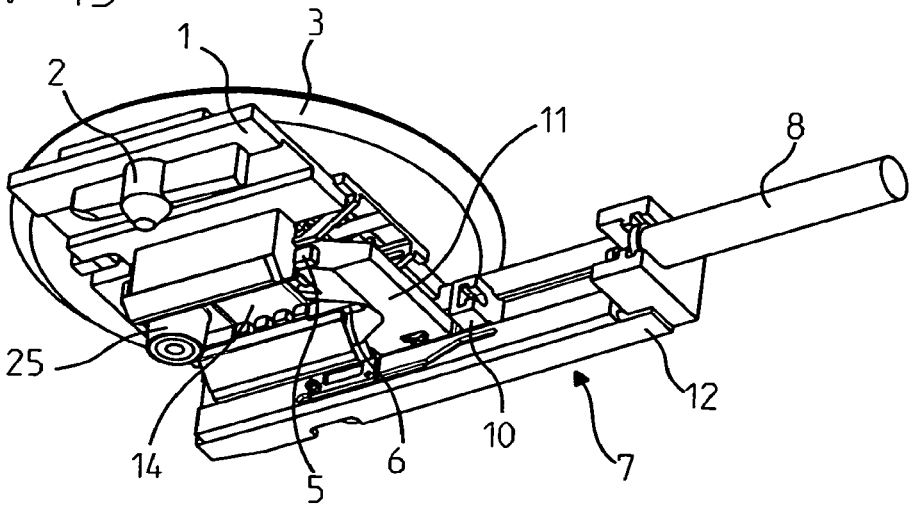

In order to initiate the emergency closure the carrier 11 is driven by the linear drive 8 in the direction of the arrow 26 (FIG. 13). The pins 17 slide along the guide grooves 16 and thus make it possible for the dummy plate 14 to sink down to the plane of movement of the casting nozzle 25.

Over the continued course of the closing process the dummy plate 14 is pushed by the carrier 11 onto the plane of movement of the casting nozzle 25 (FIG. 14) until it presses the latter out of the casting position. In the final closing position (FIG. 15) the dummy plate 14 is now in the casting position in which it totally interrupts the casting channel of the casting device.

The casting nozzle changer according to FIG. 16 to FIG. 18 is substantially structurally identical to the one according to FIG. 12 to FIG. 15, but additionally has a nozzle gripper 27 for removing the worn casting nozzles. The nozzle gripper 27 has a receiving head 28 comprising a holding magnet 29 for the worn casting nozzles and which is fastened to a swivel arm 30 of an actuation rod 31 with a handle 32 guided parallel to the direction of movement such that it can be rotated, retracted and extended. After receiving the worn casting nozzle the receiving head 28 is drawn out by the actuation rod 31 in the direction of the arrow 33 (FIG. 16), is then swivelled out in the direction of the arrow 34 (FIG. 17), and then passes in the direction of the arrow 35 (FIG. 18) to a discharge point for the worn casting nozzle.

The invention is sufficiently demonstrated by these exemplary embodiments. In principle, instead of the actuation member a means acting in the same way could also be provided.

The invention claimed is:

1. A nozzle tube changer for a casting device for producing metallurgic products, comprising:

an actuation member for moving a nozzle tube from a waiting position into a casting position in which the nozzle tube is pressed against an outlet sleeve of the casting device to form a casting channel the nozzle tube having a plane of movement in which it is moved from the waiting position to the casting position, a dummy plate having a first position in which it is situated above the plane of movement of the nozzle tube and a second position in which it is situated in the plane of movement of the nozzle tube, the dummy plate being movable from the first position to the second position, the actuation member being configured to push the dummy plate, after having been moved from the first position to the second position, under the casting channel to cause the nozzle tube in the casting position to be removed from the casting position and to close the casting channel.

2. The nozzle tube changer of claim 1, wherein the actuation member includes a carriage that moves in a direction of movement of the nozzle tube and a carrier flexibly connected to the carriage.

3. The nozzle tube changer of claim 2, wherein the carrier is hinged on the carriage about an axis transverse to the direction of movement of the nozzle tube.

4. The nozzle tube changer of claim 2, wherein the dummy plate is coupled to the carrier.

5. The nozzle tube changer of claim 4, further comprising hook-shaped suspension elements that couple the dummy plate to the carrier.

6. The nozzle tube changer of claim 5, wherein the carrier includes recesses for receiving the suspension elements.

7. The nozzle tube changer of claim 2, wherein the dummy plate includes a horizontal longitudinal groove and a linked guide groove at an angle to the horizontal longitudinal groove, the carriage including a pin movable in the horizontal longitudinal groove and the guide groove.

8. The nozzle tube changer of claim 7, wherein the actuation member is configured to move the dummy plate to vary the position of the pin in at least one of the horizontal longitudinal groove and the guide groove.

9. The nozzle tube change of claim 7, wherein the dummy plate is positioned with the pin in the guide groove in the first position, the actuation member being configured to push the dummy plate to cause the pin to slide along the guide groove and thereby lower the dummy plate from the first position to the second position.

10. The nozzle tube changer of claim 2, wherein the dummy plate includes, on each side, a horizontal longitudinal groove and a linked guide groove at an angle to the horizontal longitudinal groove, the carriage including, on each side, a pin movable in the horizontal longitudinal groove and the linked guide groove on the respective side of the dummy plate.

11. The nozzle tube changer of claim 2, wherein the dummy plate includes, on each side, a horizontal longitudinal groove and a linked guide groove at an angle to the horizontal longitudinal groove, the carriage including, on each side, two pins movable in the horizontal longitudinal groove and the linked guide groove on the respective side of the dummy plate.

12. The nozzle tube changer of claim 2, wherein the carriage includes a horizontal longitudinal groove and a linked guide groove at an angle to the horizontal longitudinal groove, the dummy plate including a pin movable in the horizontal longitudinal groove and the guide groove.

13. The nozzle tube changer of claim 2, further comprising a pre-tensioning spring for loading the dummy plate.

14. The nozzle tube changer of claim 2, further comprising a spring that urges the dummy plate from the first position toward the second position.

15. The nozzle tube changer of claim 2, further comprising a linear drive for driving the actuation member, the linear drive including a piston rod coupled to the carriage.

16. The nozzle tube changer of claim 15, wherein the linear drive is situated on one side of the nozzle tube changer, further comprising a nozzle gripper situated on an opposite side of the nozzle tube changer for removing the nozzle tube from the nozzle tube changer.

17. The nozzle tube changer of claim 16, wherein the nozzle gripper includes a swivel-out receiving head having a holding magnet for the nozzle tube being removed, and an actuation rod having an end to which the holding magnet is fastened, the actuation rod being movable in a direction parallel to the direction of movement of the nozzle tube.

18. The nozzle tube changer of claim 1, wherein the dummy plate is configured to be pushed in beneath the casting channel and from this position, drawn back by the actuation member into the waiting position so that a new exchange nozzle can be pushed into the casting position.

19. The nozzle tube changer of claim 1, wherein the actuation member is further configured to move the dummy plate from the first position to the second position.

20. The nozzle tube changer of claim 1, further comprising a base plate and guide rails on the base plate, the plane of movement of the nozzle tube being defined by the guide rails.

* * * * *